US007779483B2

(12) United States Patent
Berry et al.

(10) Patent No.: US 7,779,483 B2
(45) **Date of Patent: *Aug. 24, 2010**

(54) ABSORBENT FINGER COVER

(76) Inventors: Janiene Berry, 1545 N. 14th Ter., Hollywood, FL (US) 33020; Antal Preiner, 1545 N. 14th Ter., Hollywood, FL (US) 33020

( * ) Notice: Subject to any disclaimer, the term of this patent is extended or adjusted under 35 U.S.C. 154(b) by 0 days.

This patent is subject to a terminal disclaimer.

(21) Appl. No.: 11/942,854

(22) Filed: Nov. 20, 2007

(65) Prior Publication Data

US 2008/0066210 A1 Mar. 20, 2008

Related U.S. Application Data

(63) Continuation-in-part of application No. 11/419,608, filed on May 22, 2006, now Pat. No. 7,316,034.

(51) Int. Cl.
*A41D 13/08* (2006.01)

(52) U.S. Cl. ..... 2/21; 223/101; 132/73

(58) Field of Classification Search ..... 2/16, 2/20, 21, 159–160, 161.1, 161.6, 161.3, 161.8, 2/163, 167–168, 161.5; 128/880; 223/101; 132/73, 73.5, 200, 285

See application file for complete search history.

(56) References Cited

U.S. PATENT DOCUMENTS 2,847,005 A * 8/1958 Bourne ..... 602/58
2,925,605 A * 2/1960 Wheeler ..... 2/21
3,263,681 A * 8/1966 Nechtow et al. ..... 2/21
3,263,682 A * 8/1966 Rosenfield ..... 602/63
3,348,541 A * 10/1967 Loebeck ..... 602/58
4,694,508 A * 9/1987 Iriyama et al. ..... 2/21
4,733,410 A * 3/1988 Glotkin ..... 2/21
4,875,247 A 10/1989 Berg
5,320,531 A * 6/1994 Delizo-Madamba ..... 433/136
5,348,153 A * 9/1994 Cole ..... 206/361
5,640,713 A * 6/1997 Ping ..... 2/21
5,761,743 A * 6/1998 Andrews et al. ..... 2/21
5,954,245 A * 9/1999 Kluesner ..... 223/101
6,128,778 A * 10/2000 Castagneri ..... 2/21
6,243,868 B1 * 6/2001 Wanzenried ..... 2/21
6,634,367 B2 10/2003 Abraham et al.
6,988,502 B2 1/2006 Tsukamoto
7,316,034 B1 * 1/2008 Berry et al. ..... 2/21

FOREIGN PATENT DOCUMENTS

JP 2001072566 3/2001

* cited by examiner

*Primary Examiner*—Tejash Patel
(74) *Attorney, Agent, or Firm*—James David Johnson

(57) ABSTRACT

An absorbent protective finger cover to be worn by aestheticians to protect the surface of their skin while performing facial extractions. The finger cover includes an inner sheath of protective elastomer material and an outer sheath of absorbent material attached to the inner protective sheath. An additional tip piece of absorbent material is disposed at a finger tip portion of the finger cover between the protective sheath and absorbent sheath to provide additional absorbency for body fluids released during the facial extraction.

15 Claims, 3 Drawing Sheets

ABSORBENT FINGER COVER

CROSS-REFERENCE TO RELATED APPLICATION

This application claims the priority from U.S. patent application Ser. No. 11/419,608 filed May 22, 2006. The foregoing application is incorporated in its entirety herein by reference.

FIELD OF THE INVENTION

The invention relates to an absorbent, protective finger cover or cot. More particularly, the invention relates to an absorbent, protective finger cover or cot having a sheath of absorbent material and a sheath of protective barrier material for wearing by aestheticians while performing facial extractions.

BACKGROUND

Finger cots, or finger covers, are worn by aestheticians performing facial extractions to protect the fingers from contact with the skin and bodily fluids of individuals receiving the facial extraction of blackheads, whiteheads, and the like. A typical finger cot is constructed from latex molded into the shape of a human finger or thumb. The latex acts as a protective barrier to prevent exposure to and infection with potential pathogens, such as bacteria, viruses, and funguses, on the skin and in bodily fluids of the aesthetician's client. Currently, aestheticians hold a piece of cotton gauze between one or more of the fingers and the thumb to collect and absorb bodily fluids produced by the skin of the client during the facial extraction process. Grasping the gauze with the finger is often awkward and difficult to hold while performing the extraction. Loose edges of the piece of gauze may also tickle or irritate the skin of the client causing the skin to itch.

Conventional finger covers include several disadvantages including their lack of any absorbent material and particularly of any additional absorbent material disposed between an inner protective layer and an outer absorbent layer. The lack of absorbent material in many conventional finger covers renders those finger covers unable to absorb fluids.

SUMMARY

An absorbent protective finger cover is provided that includes a sheath of protective barrier material, a sheath of absorbent material, and a tip piece of an absorbent material. The finger cover can be worn by aestheticians while performing facial extractions or other procedures during which the aesthetician's finger may contact the client's skin and bodily fluids. Both the sheath of protective barrier material and the sheath of absorbent material may include an open end and a closed end and are shaped to receive and cover a human finger. The sheath of absorbent material can be attached securely over an exterior surface of the sheath of protective barrier material and is shaped and sized to fit snugly over and around the sheath of protective barrier material. The tip piece of absorbent material can be disposed at the closed end of the finger cover to provide additional absorption capacity to the finger cover.

The sheath of protective barrier material may prevent contact between the aesthetician's skin and the skin and bodily fluids of an individual undergoing the facial extraction. The sheath of protective barrier material can be constructed from an elastomer material, for example, latex. The sheath of absorbent material and the tip piece of absorbent material collect and absorb bodily fluid produced by the skin of the individual undergoing the facial extraction. The absorbent material from which the sheath of absorbent material and the tip piece of absorbent material are constructed can be a natural cotton gauze.

The tip piece of absorbent can be disposed at the closed end of the finger cover between the sheath of protective barrier material and the sheath of absorbent material. The tip piece may provide the aesthetician or other wearer with additional absorbency to collect bodily fluids produced by an individual's skin while undergoing a facial extraction. The sheath of absorbent material can be attached securely to the exterior surface of the sheath of protective barrier material using an adhesive. The finger cover can be sized and shaped to fit over and around the distal phalanx of the finger. The finger cover may be manufactured in two shapes: one shape to fit over and around the thumb and a second shape to fit over and around any of the other fingers of the wearer.

One advantage of the absorbent finger cover is the finger cover's ability to be worn over the fingers to prevent contact with and exposure to potential pathogens. Another advantage of the absorbent finger cover is the inclusion of additional absorption capacity to absorb and collect bodily fluids from the surface of the skin during, for example, facial extractions. The absorbent finger cover is also advantageous in that the finger cover provides aestheticians with a protective and absorbent finger cover to be worn while performing facial extractions of blackheads, whiteheads, other pore plugs, and skin lesions.

The finger cover also provides an advantage in that the finger cover protects the wearer's fingers from exposure and contact with the skin and bodily fluids of an individual receiving the facial extraction while also permitting the collection and absorption of bodily fluids without tickling or irritating the skin of the individual. The outer sheath of absorbent material provides an advantage by eliminating the need for holding or grasping a separate piece of cotton gauze while performing the facial extraction.

One advantage of the method is that the present method permits bodily fluids to be removed from the skin of a person having a facial extraction while freeing both hands of the aesthetician to perform the extraction rather than requiring that the aesthetician use one or both hands to grasp a separate piece of cloth or gauze to absorb the fluids.

Accordingly, the invention features a finger cover that includes a first sheath having a protective barrier material shaped and sized to cover a human finger. The first sheath further includes an open end through which the finger can be inserted and a closed end. The finger cover further includes a second sheath constructed from a first piece of absorbent material and enveloping at least a portion of the first sheath, and a tip piece constructed from a second piece of absorbent material and attached to the closed end of the first sheath.

In another aspect, the invention features at least one tip piece selected that can be an intermediate tip piece disposed between the first sheath and the second sheath, or an external tip piece attached over an exterior surface of the closed end of the second sheath.

In another aspect, the invention features the tip piece that can be complementary in shape to the distal phalanx of the human finger.

In another aspect, the invention features the tip piece constructed in a shape such as, for example, cap-shaped and thimble-shaped. The tip piece may fit over most or all of the distal phalanx of the human finger.

In another aspect, the invention features the second sheath which may include a plurality of layers of second sheaths.

Each layer may be constructed from an identical material such as, for example, cotton gauze, polymer gauze, natural cloth fabric, synthetic cloth fabric, cotton ball material, and combinations, blends, and multiple layers of any of these absorbent materials.

In another aspect, the invention features the second sheath which may include a plurality of layers of second sheaths. Each layer may be constructed from a different material such as, for example, cotton gauze, polymer gauze, natural cloth fabric, synthetic cloth fabric, cotton ball material, and combinations, blends, and multiple layers of any of these absorbent materials.

In another aspect, the invention features the second sheath which may further include an inner layer that directly contacts the first sheath and at least one outer layer attached over the inner layer.

In another aspect, the invention features the absorbent material having at least one outer layer that is less absorbent than the absorbent material of the inner layer.

In another aspect, the invention features the finger cover wherein each of the outer layers is progressively less absorbent than the layer over which each out layer is connected.

In another aspect, the invention features the second sheath which may be attached securely over the exterior surface of the first sheath using an adhesive.

In another aspect, the invention features the second sheath which may be attached securely over an exterior surface of the first sheath by rolling the second sheath into a cuff surrounding the open end of the first sheath.

The invention also features a glove that may include a first sheath shaped and sized to cover a human hand. The first sheath may be constructed from a protective barrier material and can include an open end and a closed end. The glove can further include a second sheath constructed from a first piece of absorbent material and shaped and sized to envelope at least a portion of the first sheath and a tip piece constructed from a second piece of absorbent material disposed at the closed end of the first sheath.

In another aspect, the invention features the tip piece of the glove including at least one of an intermediate tip piece disposed between the first sheath and the second sheath, and an external tip piece attached over an exterior surface of the closed end of the finger cover.

In another aspect, the invention features the glove having at least one intermediate tip piece attached over the closed end of the first sheath of at least one finger portion of the finger cover.

In another aspect, the invention features the glove including at least one external tip piece attached over the closed end of the second sheath of at least one finger portion of the glove.

In another aspect, the invention features the glove having a plurality of layered second sheaths attached over the first sheath.

In another aspect, the invention features the second sheath of the glove being attached securely over an exterior surface of the first sheath using an adhesive.

In another aspect, the invention features the second sheath of the glove being attached securely over an exterior surface of the first sheath by rolling the second sheath into a cuff surrounding the open end of the first sheath.

In another aspect, the invention features the open end of the first sheath of the glove including an elastic portion sized slightly smaller than the human hand. The open end and elastic portion may be capable of expanding to permit entry of the hand into the glove and of contracting to fit snugly around the hand.

A method of the invention includes the steps of inserting a finger cover over a finger. The finger cover can include a first sheath constructed from a protective barrier material shaped and sized to cover at least part of the finger. The first sheath may include an open end through which the finger can be inserted and a closed end. The finger cover can further include a second sheath constructed from a first piece of absorbent material and enveloping at least a portion of the first sheath and a tip piece constructed from a second piece of absorbent material and attached to the closed end of the first sheath. Another step of the method includes removing fluid from the skin of a subject. Still another step of the method includes absorbing the removed material into the first and second pieces of absorbent material.

Another method of the invention includes the steps of wearing and using at least two finger covers to remove fluid from the skin of a subject.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
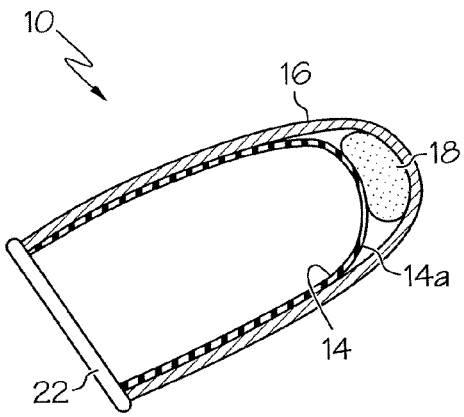
FIG. 1 is a cross-sectional side perspective view of an absorbent finger cover.
Figure 2:
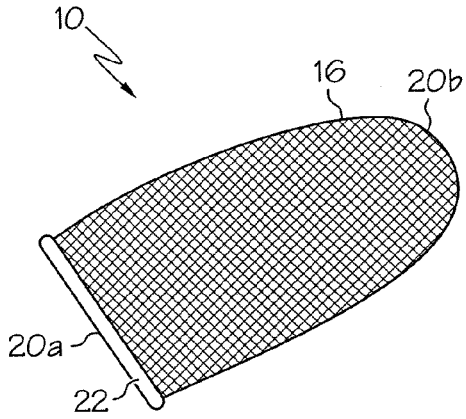
FIG. 2 is a side perspective view of the absorbent finger cover shown in FIG. 1.
Figure 3:
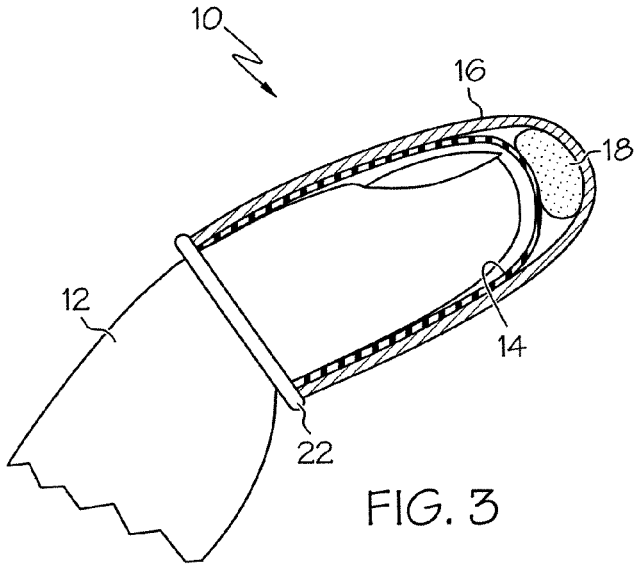
FIG. 3 is a cut-away perspective view of a human finger inserted into the absorbent finger cover shown in FIG. 1.

FIGS. 1-3 illustrate an absorbent protective finger cover 10 to be worn by aestheticians over a finger 12 while performing facial extractions or other procedures during which the aesthetician's finger may contact the client's skin and bodily fluids. The finger cover 10 can include a first sheath constructed from protective barrier material 14, a second sheath 16 constructed from a first piece of absorbent material, and a tip piece 18 constructed from a second piece of absorbent material. The sheath of absorbent material 16 can envelope the sheath of barrier material 14. The sheath of protective barrier material 14 may also include an open end 20*a* and a closed end 20*b* and can be shaped to receive and cover a human finger as shown in FIG. 3. The sheath of absorbent material 16 can be attached securely over an exterior surface 14*a* of the sheath of protective barrier material 14 and may be shaped and sized to fit snugly over and around the sheath of protective barrier material 14. The tip piece 18 of absorbent material can be located at the closed end 20*b* of the finger cover 10 to provide additional absorption capacity to the finger cover. The finger cover 10 can be designed for wearing and use by an aesthetician to perform facial extractions of blackheads and whiteheads.

The sheath of protective barrier material 14 may prevent contact between the aesthetician's skin and the skin and bodily fluids of an individual undergoing the facial extraction. The sheath of protective barrier material 14 can be an elastomer material, such as latex. The sheath of absorbent material 16 and the tip piece 18 of absorbent material collect and absorb bodily fluid produced by the skin of the individual undergoing the facial extraction. The sheath of absorbent material 16 and the tip piece 18 of absorbent material may be manufactured from identical materials or from different materials. The absorbent material from which the sheath of absorbent material and the tip piece of absorbent material are manufactured can be selected from one or more of the following materials: cotton or polymer gauze, natural or synthetic cloth fabric, cotton ball material, or combinations, blends, or multiple layers of any of these absorbent materials.

The tip piece 18 of absorbent material can be disposed at the closed end 20*b* of the finger cover 10 between the sheath of protective barrier material 14 and the sheath of absorbent material 16. The tip piece 18 may provide the aesthetician or other wearer with additional absorbency to collect bodily fluids produced by an individual's skin while undergoing a facial extraction. In an exemplary embodiment, the sheath of absorbent material 16 can be attached securely to the exterior surface 14*a* of the sheath of protective barrier material 14 using an adhesive (not shown in the drawings). However, other means for firmly engaging the absorbent sheath 16 and the protective sheath 14 may be employed, including securely attaching the sheath of absorbent material 16 to the exterior surface 14*a* of the sheath of protective barrier material 14 by rolling the absorbent material sheath into a cuff 22 surrounding the open end 20*a* of the protective barrier material sheath 14.

In one embodiment, the open end 20*a* of the sheath of protective barrier material 14 may include an elastic portion (not shown in the drawings) sized slightly smaller than the finger 12. The elastic portion enables the sheath of protective material and sheath of absorbent material around the open end of the finger cover to expand, thereby permitting entry of the finger into the finger cover and allowing the open end to contract to fit snugly around the finger of the wearer.

The finger cover 10 may be sized and shaped to fit over and around the distal phalanx of the finger, however, the finger cover can also be manufactured in lengths and shapes to fit over and around the finger up to the middle or even proximal phalanges. In one embodiment, finger covers can be worn by the aesthetician over the index finger and thumb. The finger cover can be manufactured in various sizes, for example, in standard small, medium, and large sizes, to accommodate the varying diameters and lengths the fingers of different wearers. The finger cover can be manufactured in two shapes: one shape to fit over and around any of the index finger, middle finger, ring finger, or little finger of the wearer and in another shape to fit over and around the thumb of the wearer.

In an exemplary embodiment, the finger cover can be manufactured in a shape and dimensions to fit over and around the distal phalanx of the finger of the wearer. However, the finger cover may also be manufactured in a shape and dimensions to fit over and around the finger extending up to the middle phalanx or proximal phalanx of the finger over which the finger cover is worn. While designed for use by aestheticians or dermatologists performing facial extractions upon individuals, the finger cover can be worn and used by any person in need of protecting their fingers while taking advantage of the absorption capabilities of the finger cover. The shape and design of the finger cover may be flexible so as not to restrict the use or movement of the finger.

Figure 4:
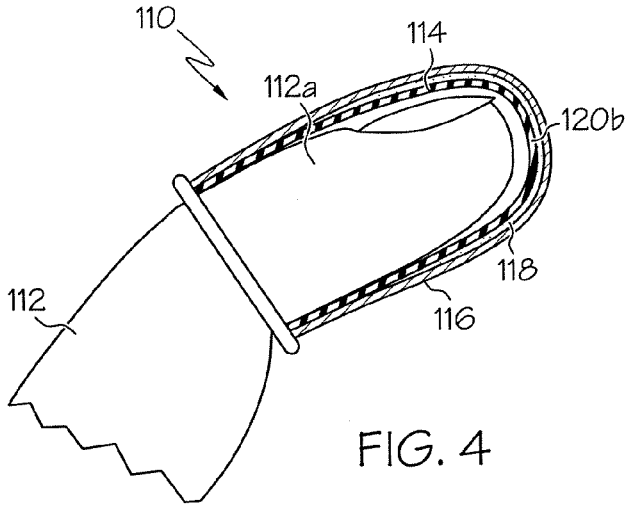
FIG. 4 is a cut-away side elevational view of a human finger inserted into one embodiment of an absorbent finger cover that includes an intermediate tip piece of absorbent material that is complementary in shape to a distal phalanx of the human finger.

Referring now to FIG. 4, in another embodiment, the absorbent finger cover 110 may include an intermediate tip piece 118 of absorbent material that is complementary in shape to a distal phalanx (or tip) 112*a* of a human finger 112. The intermediate tip piece can be disposed at a closed end 120*b* of the finger cover 110 between a first sheath 114 constructed from protective barrier material and a second sheath 116 constructed from absorbent material. The intermediate tip piece 118 may be cap-shaped or thimble-shaped to fit over most or all of the distal phalanx of the human finger.

Figure 5:
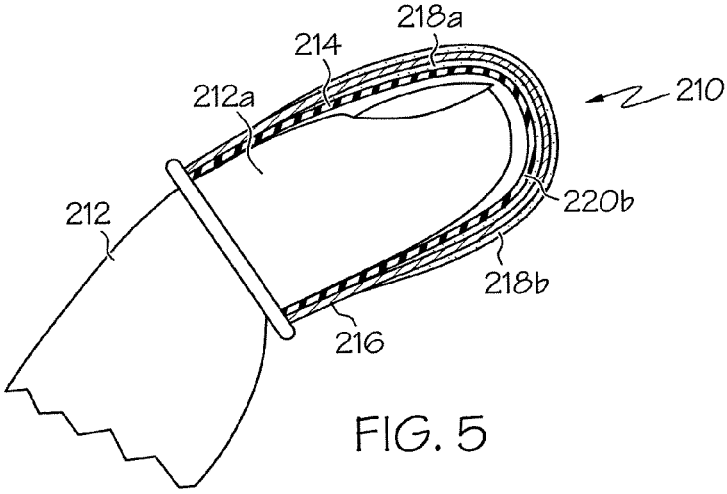
FIG. 5 is a cut-away side elevational view of a human finger inserted into one embodiment of an absorbent finger cover that includes an intermediate tip piece of absorbent material and an external tip piece of absorbent material.

Referring now to FIG. 5, in another embodiment, the absorbent finger cover 210 may include an intermediate tip piece 218*a* of absorbent material and an external tip piece 218*b* of absorbent material. The intermediate tip piece can be disposed at a closed end 220*b* of the finger cover 210 between a first sheath 214 constructed from protective barrier material and a second sheath 216 constructed from absorbent material. The external tip piece 218*b* can be attached over and around the first sheath 214 to provide additional absorbency and cushioning. Both the intermediate tip piece 218*a* and the external tip piece 218*b* can be cap-shaped or thimble-shaped to fit over most or all of a distal phalanx 212*a* of a human finger 212.

Figure 6:
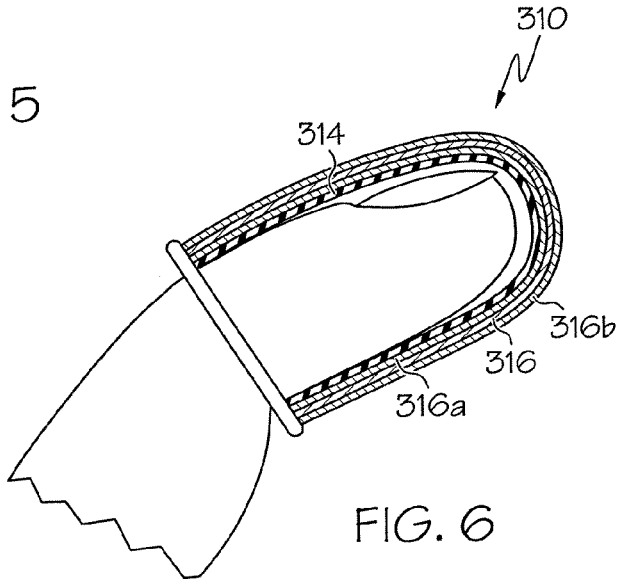
FIG. 6 is a cut-away side elevational view of a human finger inserted into one embodiment of an absorbent finger cover that includes a plurality of layers of generally tubular sheaths of absorbent material.

Referring now to FIG. 6, in another embodiment, the absorbent finger cover 310 may include a plurality of layered, generally tubular second sheaths 316 constructed from absorbent material surrounding one or more first sheaths 314 constructed from protective barrier material. This embodiment of the finger cover may also include one or more intermediate tip pieces of absorbent material, external tip pieces of absorbent material, or both intermediate and external tip pieces. Each of the plurality of second sheaths 316 can be constructed from a single material or from different materials selected from one or more of the following materials: cotton gauze, polymer gauze, natural cloth fabric, synthetic cloth fabric, cotton ball material, or combinations, blends, or multiple layers of any of these absorbent materials.

In one embodiment of the absorbent finger cover 310 illustrated in FIG. 6, the plurality of second sheaths 316 may be configured so that the most absorbent material forms an inner layer 316*a* of absorbent material that can be in direct contact with the first sheath 314. The second sheaths constructed from the least absorbent material can be attached over one another so that the least absorbent sheath of material forms an outer layer 316*b* of absorbent material. The plurality of second sheaths may form one or more outer layers attached to the inner layer. In this way, fluids absorbed by the one or more outer layers formed by the plurality of second sheaths can be drawn through the outer layers into the inner layer 316*a* that is most absorbent, thereby preventing saturation of the outer layers which could inhibit absorption.

Figure 7:
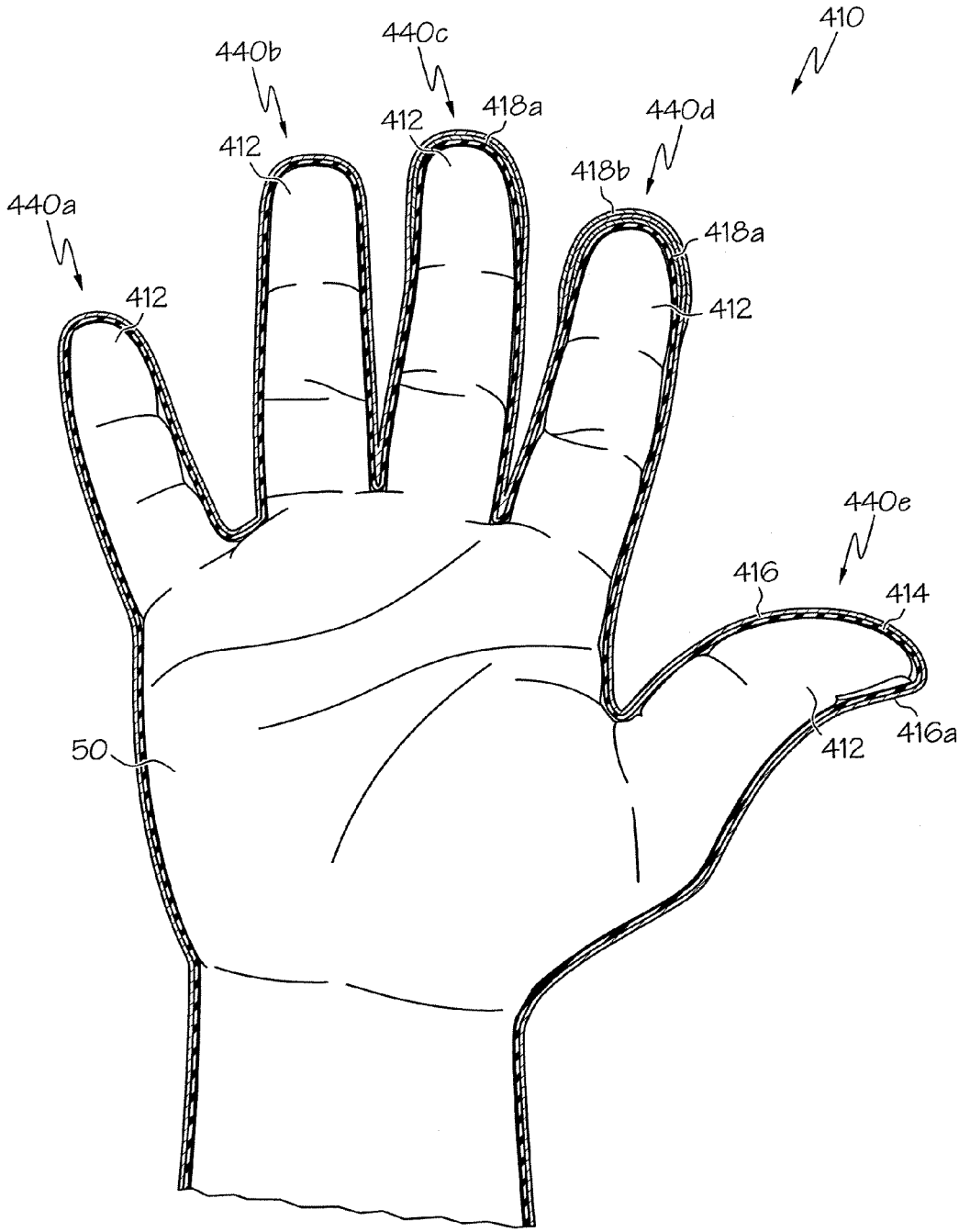
FIG. 7 is a cross-sectional side elevational view of one embodiment of a glove-shaped absorbent finger cover that includes a sheath of protective barrier material and a sheath of absorbent material to cover a human hand and tip pieces of absorbent material over each finger portion of the glove-shaped absorbent finger cover.

Referring now to FIG. 7, in another embodiment, the absorbent finger cover may be a glove 410 and can include a first sheath 414 constructed from protective barrier material and a second sheath 416 constructed from absorbent material to cover a human hand 50 and tip pieces of absorbent material over each finger portion 440*a*, 440*b*, 440*c*, 440*d*, and 440*e* of the glove 410. In one embodiment, the glove 410 may include one or more intermediate tip pieces 418*a* of absorbent material disposed between the first sheath 414 and the second sheath 416 over one or more finger tips 412. In another embodiment, the glove 410 cover can include one or more external tip pieces 418*b* of absorbent material attached over an exterior surface 416*a* of the second sheath 416 of absorbent material to cover one or more finger tips 412. In still another embodiment, the glove 410 may include a plurality of layered sheaths of absorbent material. The glove 410 may also include a plurality of layered sheaths of protective barrier material.

A method is also provided for safely removing bodily fluids from the skin of another person. The method includes the steps of providing at least one finger cover as described in one of the embodiments above, inserting at least a finger of a user into the at least one finger cover, and absorbing and removing bodily fluids from the skin of the other person by contacting the at least one finger cover with the bodily fluids on the skin. The bodily fluids may include, for example, blood and fluids produced or excreted by sebaceous and sweat glands. In an exemplary embodiment, at least two finger covers are worn and used.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method for removing fluid from skin of a subject, the method comprising the steps of:

(a) inserting a finger cover over a finger, the finger cover comprising:

(i) a first generally tubular sheath comprising a protective barrier material shaped and sized to cover at least part of the finger, and the first generally tubular sheath further comprising an open end through which the finger can be inserted and a closed end;

(ii) a second generally tubular sheath comprising a first piece of absorbent material and enveloping at least a portion of the first generally tubular sheath; and (iii) at least one discrete tip piece comprising a second piece of absorbent material positioned between the first and second tubular sheath generally at a tip region thereof;

(b) removing fluid from the skin of a subject; and (c) absorbing the removed material into the first and second pieces of absorbent material.

2. The method of claim 1, wherein at least two finger covers are worn and used.

3. A finger cover comprising:

a first generally tubular sheath comprising a protective barrier material shaped and sized to cover a human finger, and the first generally tubular sheath further comprising an open end through which the finger can be inserted and a closed end;

a second generally tubular sheath comprising a first piece of absorbent material and enveloping at least a portion of the first sheath; and at least one discrete tip piece comprising a second piece of absorbent material positioned between the first and second tubular sheath generally at a tip region thereof.

4. The finger cover of claim 3, wherein the at least one tip piece comprises an intermediate tip piece disposed between the first generally tubular sheath and the second generally tubular sheath, and the finger cover further comprises an external tip piece attached over an exterior surface of the closed end of the second generally tubular sheath.

5. The finger cover of claim 3, wherein the tip piece is complementary in shape to the distal phalanx of the human finger.

6. The finger cover of claim 3, wherein the tip piece is selected from a shape in the group consisting of: cap-shaped and thimble-shaped; and wherein the tip piece fits over most or all of the distal phalanx of the human finger.

7. The finger cover of claim 3, wherein the second generally tubular sheath comprises a plurality of layers of generally tubular sheaths and each layer is constructed from an identical material selected from the group consisting of: cotton gauze, polymer gauze, natural cloth fabric, synthetic cloth fabric, cotton ball material, and combinations, blends, and multiple layers of any of these absorbent materials.

8. The finger cover of claim 3, wherein the second generally tubular sheath comprises a plurality of layers of generally tubular sheaths and each layer is constructed from a different material selected from the group consisting of: cotton gauze, polymer gauze, natural cloth fabric, synthetic cloth fabric, cotton ball material, and combinations, blends, and multiple layers of any of these absorbent materials.

9. The finger cover of claim 3, wherein the second generally tubular sheath comprises: an inner layer that directly contacts the first generally tubular sheath; and at least one outer layer attached over the inner layer.

10. The finger cover of claim 9, wherein the absorbent material comprising the at least one outer layer is less absorbent than the absorbent material of the inner layer.

11. The finger cover of claim 10, wherein each of the at least one outer layers is progressively less absorbent than the layer over which it is connected.

12. The finger cover of claim 3, wherein the second generally tubular sheath is attached securely over the exterior surface of the first generally tubular sheath using an adhesive.

13. The finger cover of claim 3, wherein the second generally tubular sheath is attached securely over an exterior surface of the first generally tubular sheath by rolling the second generally tubular sheath into a cuff surrounding the open end of the first generally tubular sheath.

14. The finger cover of claim 3, wherein the second generally tubular sheath and the tip piece comprise identical materials.

15. The finger cover of claim 3, wherein the second generally tubular sheath and the tip piece comprise different materials.

* * * * *